US005107303A

United States Patent [19]

Miyamoto et al.

[11] Patent Number: 5,107,303

[45] Date of Patent: Apr. 21, 1992

[54] CLEANING STRUCTURE FOR MOVING IMAGE RETAINER FOR USE IN AN IMAGE FORMING DEVICE

[75] Inventors: Tsuyoshi Miyamoto, Osaka; Koji Shinkawa; Shouichi Fujita, both of Nara; Hideyuki Nishimura; Katsuhiro Nagayama, both of Yamatokoriyama, all of Japan

[73] Assignee: Sharp Kabushiki Kaisha, Osaka, Japan

[21] Appl. No.: 478,570

[22] Filed: Feb. 12, 1990

[30] Foreign Application Priority Data

Feb. 15, 1989 [JP] Japan ..... 1-37170
Mar. 31, 1989 [JP] Japan ..... 1-82904

[51] Int. Cl.[5] ..... G03G 21/00

[52] U.S. Cl. ..... 355/296; 15/256.5; 118/652

[58] Field of Search ..... 355/296, 297, 299; 15/256.5, 256.51, 256.52, 1.5; 430/125; 118/652, 3, 15

[56] References Cited

U.S. PATENT DOCUMENTS 4,032,229 6/1977 Tani et al. ..... 355/297
4,131,359 12/1978 Honda ..... 355/299 X
4,149,797 4/1979 Imperial ..... 355/295 X
4,739,370 4/1988 Yoshida et al. ..... 355/296

FOREIGN PATENT DOCUMENTS 0176083 10/1982 Japan ..... 355/297
0092983 4/1987 Japan ..... 355/297
0250676 10/1988 Japan ..... 355/297

*Primary Examiner*—A. T. Grimley
*Assistant Examiner*—Thu Anh Dang

[57] ABSTRACT

A cleaning structure of an image forming device comprises an image retainer, a cleaning blade supported to touch a moving surface of the image retainer, a cleaning roller supported to touch the moving surface of the image retainer in a position downstream from the position of the cleaning blade. The cleaning roller comprises a roller shaft, a roller base layer and a fluorocarbon polymer layer which is excellent in noncohesiveness and slip property.

11 Claims, 3 Drawing Sheets

CLEANING STRUCTURE FOR MOVING IMAGE RETAINER FOR USE IN AN IMAGE FORMING DEVICE

BACKGROUND OF THE INVENTION i) Field of the Invention

The present invention relates to a cleaning structure of an image forming device and, more specifically, it relates to a cleaning structure of an image retainer used in an image forming device such as an electrostatic transfer copying machine and a laser printer.

ii) Description of the Prior Art

A conventional image forming machine comprises a structure for cleaning an image retainer such as a photoconductor and an intermediate transfer sheet. Usually, toner deposited on the image retainer should be cleared away before the next image formation cycle. For this purpose, for example, a blade cleaning process where an edge of urethane rubber is pressed against the image retainer to clear away the toner and a fur brush cleaning process where a fur brush is used have been employed.

The blade cleaning process has been widely used because it can be carried out with a simple system at a low cost.

However, if a very small amount of toner remains on the photoconductor or the intermediate transfer sheet, or if toner is fused by heat or pressure on them, such toner can not be cleared away by the blade alone, and a filming layer should be gradually formed. Consequently, the transfer capability deteriorates and the quality of a finished image becomes poor.

Especially in the case of a double transfer process where the intermediate transfer sheet is used, if the intermediate transfer sheet is slightly filmed over with toner, the transfer efficiency is considerably reduced.

Accordingly, it is an object of the present invention to provide a cleaning structure by which the reduction of the efficiency in the image transfer can be prevented, and images can always be securely formed.

SUMMARY OF THE INVENTION

A cleaning structure of an image retainer for an image forming device according to the present invention comprises an image retainer; a cleaning blade held by blade supporting means and placed at a desired position on the image retainer; and a cleaning roller held by roller supporting means and placed in a position downstream from the desired position of the cleaning blade on the image retainer with regard to the rotation of the image retainer; the blade supporting means and the roller supporting means putting the cleaning blade and the cleaning roller in contact with a moving surface of the image retainer so that they can remove toner remaining on the surface of the image retainer; the cleaning roller being formed of a roller shaft, a roller base layer and a roller surface layer; and the roller surface layer being a functional polymer layer excellent in noncohesiveness and slip property.

Thus, in an aspect of the present invention, not only the cleaning blade but also the cleaning roller in the downstream position are put in contact with the moving image retainer to remove a film layer of the remaining toner which has not been removed by the cleaning blade alone, so that the reduction of the efficiency in image transfer can be prevented.

The cleaning roller must be formed on its surface with a polymer layer which is excellent in noncohesiveness and slip property.

A fluorocarbon polymer layer is preferably used for the polymer layer, and more preferably, PFA (tetrafluoroethylene/perfluoroalkoxyethylene copolymer) and FEP (tetrafluoroethylene/hexafluoropropylene copolymer) are used.

Further, in another aspect of the present invention, in forming an image (e.g., in making a copy), the cleaning roller does not always touch and thereby rub the surface of the moving image retainer, but will touch and thereby rub it several times, for example, by n times for m times of image formation ($m>n$). As a result, the surface of the image retainer is not easily damaged. Specifically, it is preferable that the cleaning roller touches the surface of the image retainer 1 to 3 times when the required copy quantity m is 10 to 20.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

A cleaning structure of an image forming device according to the present invention will now be described using an example of a cleaning structure of a color copying machine.

A constitution of the color copying machine employing the cleaning structure of the present invention will be explained with reference to FIG. 3.

Figure 3:
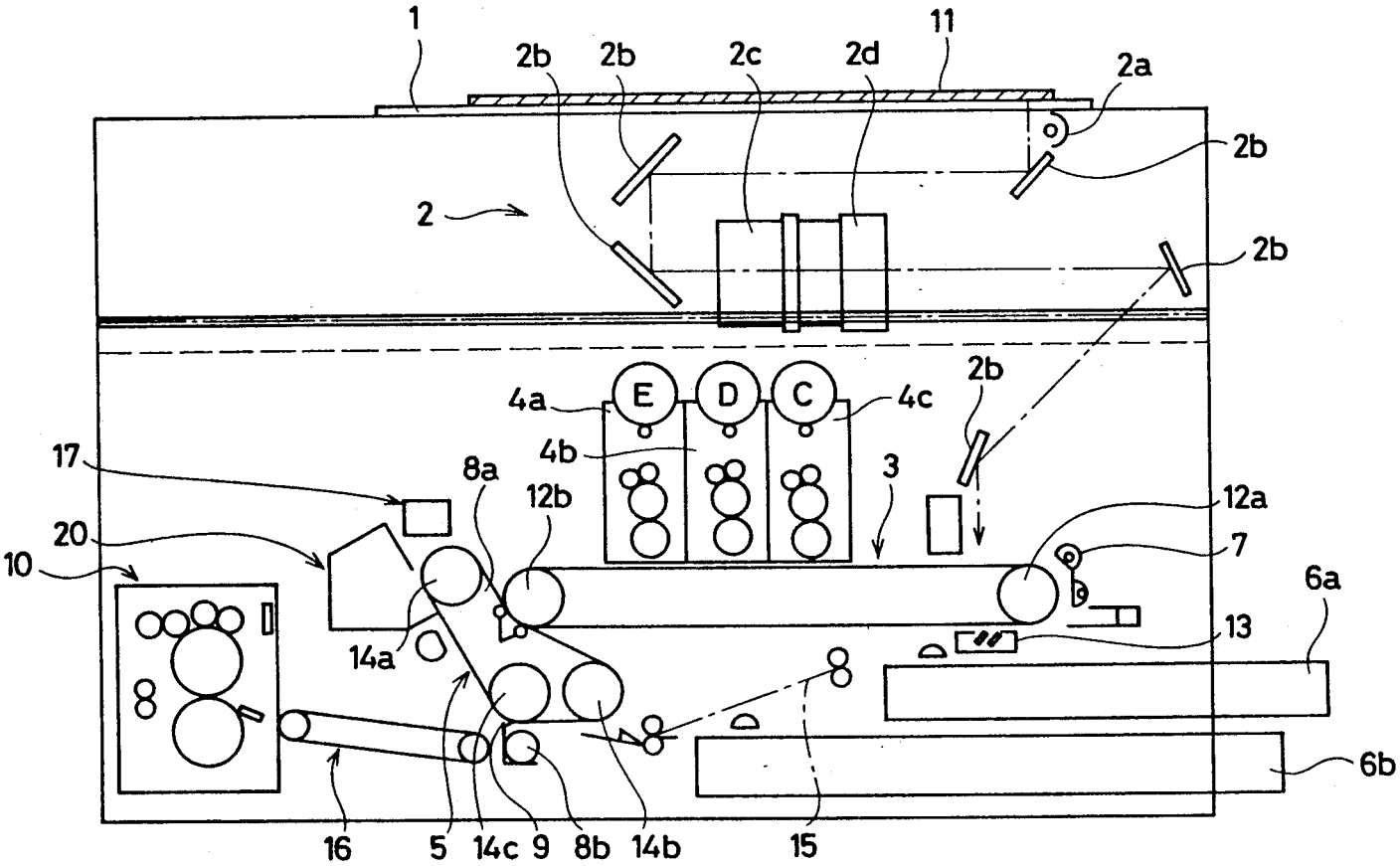
FIG. 3 is a schematic view showing a full color copying machine employing the cleaning structure of the embodiment.

In FIG. 3, the color copying machine comprises a transparent original plate 1, an exposure optical system 2, a photoconductor sheet 3, developer tanks **4*a* to 4*c* separated for respective color components, an intermediate transfer sheet 5, paper supplying cassettes 6*a*, 6*b* for respective paper sizes, an electrostatic charger 7, transfer chargers 8*a*, 8*b*, a plate-shaped separating charger 9, and a fusing unit 10**.

The exposure optical system 2 comprises a light source lamp **2*a* for emitting light to an original 11 laid on the original plate 1, a plurality of reflecting mirrors 2*b* for leading the light reflected from the original 11 onto the photoconductor sheet 3 as shown by a dot-dash line, a imaging lens 2*c* placed on the light path and a color separation filter 2d** having color filters in three primary colors (red, green and blue).

The photoconductor sheet 3 is rotated by two rollers 12a, 12b, and the developer tanks 4a to 4c are disposed near the center portion of the upper face of the photoconductor sheet 3, but not in contact with it. The electrostatic charger 7 and other components are disposed around the first roller 12a, and a cleaning mechanism 13 is placed on the lower face of the photoconductor sheet 3 around the first roller 12a so as to remove toner remaining on the photoconductor sheet 3.

The intermediate transfer sheet 5 is placed around the second roller 12b and rotated by three rollers 14a to 14c. The intermediate transfer sheet 5 is pressed on one side to come in contact with the photoconductor sheet 3 on the second roller 12b, and a first transfer roller 8a is placed on the other side of the intermediate transfer sheet 5 just in contact with the photoconductor sheet 3. Further, a second transfer roller 8b and the separation charger 9 are placed close to the lower portion of the intermediate transfer sheet 5. Reference numerals 15 and 16 denote recording paper and a transfer path, respectively.

Figure 1:
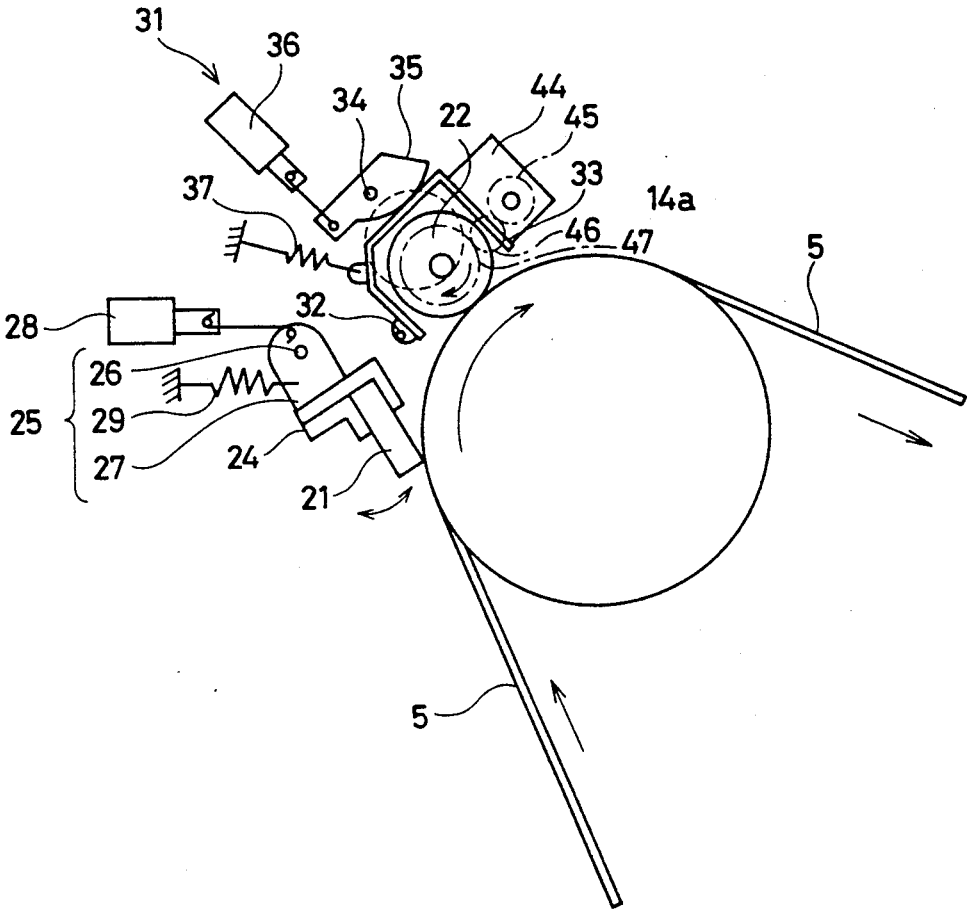
FIG. 1 is an elevational view showing an embodiment of a cleaning structure of an image forming device according to the present invention.

The cleaning structure 20 of the present invention is placed very close to the intermediate sheet 5 serving as an image retainer. As shown in FIGS. 1 and 3, the cleaning structure 20 has a cleaning blade 21 positioned in an upstream position with regard to the flow of the moving intermediate transfer sheet 5 and a cleaning roller 22 in a downstream position to touch and rub the surface of the intermediate transfer sheet 5. A noncohesive functional polymer layer 23 excellent in slip property is formed on the surface of the cleaning roller 22.

The cleaning blade 21 is made of polyurethane rubber and held by a holder 24 as shown in FIG. 1.

A blade driving device 25 serving as blade supporting means is provided to attach and detach the cleaning blade 21 to and from the intermediate transfer sheet 5. As shown in FIG. 1, the driving device 25 comprises a supporter 27 for supporting the holder 24 and rotating it about a supporting shaft 26, a solenoid 28 having one end connected to the supporter 27, for moving the cleaning blade 21 to come in contact with the intermediate transfer sheet 5, and a spring 29 having one end connected to the supporter 27, for moving the cleaning blade 21 to detach from the intermediate transfer sheet 5.

The blade 21 is kept away from the intermediate transfer sheet 5 until an image is transferred to paper after being transferred from the photoconductor sheet 3 with yellow, magenta and cyanogen toner in this order, but the blade 21 comes in contact with the intermediate transfer sheet 5 to clear away the toner after the transfer of the image is completed.

The cleaning roller 22 can be attached and detached to and from the intermediate transfer sheet 5, similar to the cleaning blade 21, and is rotated in the reverse direction to the direction of the movement of the intermediate transfer sheet 5.

As shown in FIG. 1, a roller driving device 31 serving as roller supporting means for attaching and detaching the cleaning roller 22 to and from the intermediate transfer sheet 5 comprises a case 33 housing the cleaning roller 22 and pivoting about a supporting shaft 32, a cam 35 coming in contact with the back of the case 33 and pivoting about a shaft 34, a solenoid 36 for moving the cam 35 to push the cleaning roller 22 towards the intermediate transfer sheet 5, and a spring 37 for pulling the case 33 to detach the cleaning roller 22 from the intermediate transfer sheet 5.

Figure 2:
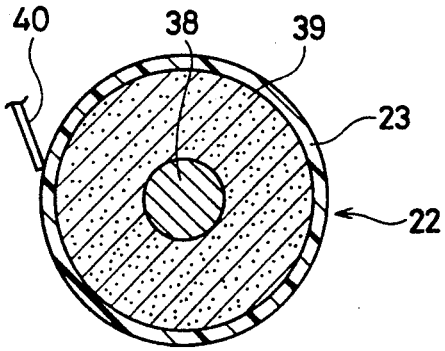
FIG. 2 is a view showing a cleaning roller of the image forming device.

As shown in FIG. 2, the cleaning roller 22 comprises a metal core 38 as a roller shaft, a roller member 39 as a roller base layer made of sponge rubber (e.g., the rubber having the hardness of 20 to 40) and the aforementioned functional polymer layer 23 as a roller face layer.

The functional polymer layer 23 is made of fluorocarbon polymers (specifically, made of PFA), and the fluorocarbon polymers are generally superior to other polymeric materials in noncohesiveness, slip property, chemical resistance, heat resistance, electrical insulating property and the like.

Further, there is provided a plate (Mylar) 40 coming in contact with the functional polymer layer 23 to clear away toner from the cleaning roller 22.

Figure 4:
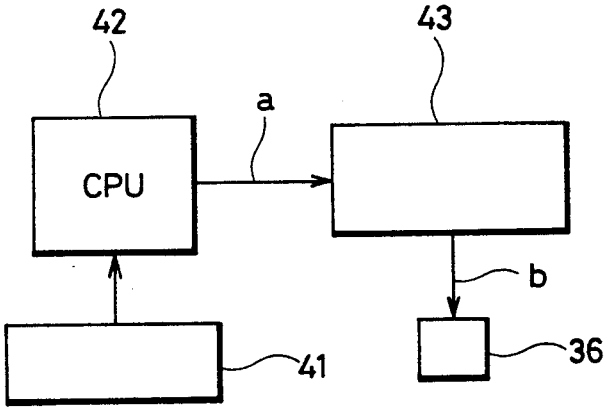
FIG. 4 is a diagram showing a solenoid drive control circuit.

FIG. 4 is a block diagram showing an architecture of a solenoid driving circuit. In FIG. 4, the circuit comprises a solenoid 36 for the roller driving device 31, a copy sensor 41 outputting a detection signal each time a copy is made, a central processing unit (CPU) 42, and a solenoid driving unit 43. The central processing unit 42 counts output signals received from the copy sensor 41 and output n solenoid signals "a" for m copies to the solenoid driving unit 43 ($m>n$).

The number of times by which the solenoid 36 works, namely, the number of times by which the cleaning roller 22 is put into contact with the intermediate transfer sheet 5 serving as an image retainer, is set not to give an adverse effect upon both the first transfer and the intermediate transfer as follows: (a) once for ten copies (the tenth sheet), (b) twice for ten copies (the ninth and tenth sheets) and (c) three times for twenty copies (the eighteenth, nineteenth and twentieth sheets), for example.

Now, the operation of the color copying machine will be simply described.

The light source 2a irradiates the original 11 put on the original plate 1 to scan several times, and the light from the original is led by the reflecting mirrors 2b to the imaging lens 2c to make an optical image. The optical image is separated into images in colors based upon respective color components by the color separation filter 2d.

The images in respective colors are successively exposed to make latent images on the photoconductor sheet 3 uniformly charged by the electrostatic charger 7. The latent images in respective colors are developed in the developer tanks 4a to 4c containing the developers of additive complementary colors (yellow, magneta and cyanogen) for color filters of the color separation filter 2d, and then transferred on the intermediate transfer sheet 5 by the first transfer roller 8 successively.

Eventually, toner images in respective colors are superposed on the intermediate transfer sheet 5 to make a single color toner image.

The color toner image is transferred by the second transfer roller 8b to the recording paper 15 which is received from either of the paper supplying cassettes 6a, 6b and closely adhered to the bottom face of the intermediate transfer sheet 5. After that, the recording paper 15 is separated from the intermediate transfer sheet 5 by the separation charger 9, and introduced to the fusing unit 10 through the transfer path 16. In this way, the color image transferred to the recording paper 15 is fused.

On the image transfer, high voltage is applied to the surface of the first and second transfer rollers 8*a*, 8*b*. The second transfer roller 8*b* comes into contact with the intermediate transfer sheet 5 only upon the image transfer, but not in contact otherwise.

After the images on the photoconductor sheet 3 is transferred to the intermediate transfer sheet 5 with yellow, magenta and cyanogen toners in this order, the blade 21 is detached from the intermediate transfer sheet 5 until a color image on the image retaining intermediate transfer sheet 5 is transferred to recording paper. After the color image is transferred to the recording paper 15, the blade 21 is pressed to come in contact with the intermediate transfer sheet 5 and the toner is cleared away. The cleaning roller 22 rotates in the reverse direction to the rotation of the intermediate transfer sheet 5 to clear away the toner which has not been caught by the blade 21. Reference numeral 45 denotes a motor fixed to the case 22, which rotates the cleaning roller 22 through gears 45, 46, 47 in the reverse direction to the rotation of the intermediate transfer sheet 5 as stated above.

At this time, since the functional polymer layer 23 of the cleaning roller 22 is very smooth in its surface, the toner can be easily clear away by merely putting the plate 40 on it.

The cleaning roller 22 is pressed to come into contact with the intermediate transfer sheet 5 in the following manner. First, after nine copies have been made, the CPU 42 outputs a signal "a", and in response to this signal the solenoid driving unit 43 outputs a signal "b" for a specific period of time while the tenth copy is made, so as to drive the solenoid 36. As a result, the cleaning roller 22 is pressed to come in contact with the intermediate transfer sheet 5 against the spring 37 and rotated in the reverse direction to the rotation of the intermediate transfer sheet 5, so as to clear away the toner which has not been caught by the blade 21. When the cleaning is completed, after a specific period of time the solenoid 36 turns off, and the spring 37 draws the cleaning roller 22 back from the intermediate transfer sheet 5.

Although the cleaning blade 21 is placed in the upstream position and the cleaning roller 22 is placed in the downstream position, this is because the cleaning blade 21 effectively clears away thick deposits of the toner on the intermediate transfer sheet 5 but can not clear away the thinly deposited toner.

On the other hand, the cleaning roller 22 can not effectively clear away the thick deposited toner but can clear away the thinly deposited toner well.

Then, in order to effectively clear away the toner, the cleaning blade 21 is placed in the upstream position to roughly remove the toner on the intermediate transfer sheet 5, and thereafter the cleaning roller 22 removes the remaining thinly deposited layer of toner. This layer of toner is like a film on the intermediate transfer sheet 5.

Although the cleaning roller 22 is formed with the metal core 38, the soft sponge rubber roller body 39 covering thereon and the fluorocarbon polymer layer 23 thereon, this is because if the surface of the roller body 39 is covered with synthetic rubber (urethane or silicon), the toner s easily deposited but can not be easily removed.

However, with the use of fluorocarbon polymers, the toner is not easily deposited and can be easily removed.

The present invention is not limited to the aforementioned embodiment, but many modifications and variations can be done within the scope of the present invention.

For example, the intermediate transfer sheet is used as the image retainer in the above embodiment, but a photoconductor may be substituted. The image retainer is not limited to a sheet as in the above embodiment, but it may be a drum.

As has been described, according to an exemplary structure of the present invention, a cleaning blade is placed in an upstream position and a cleaning roller is placed in a downstream position to touch and thereby rub the surface of a moving image retainer. The cleaning blade in the upstream position roughly removes the toner on the image retainer, and then the cleaning roller in the downstream position removes the remaining thinly deposited toner which is like a film. In this way, the toner can be effectively cleared away.

Additionally, a functional polymer layer excellent in noncohesiveness and slip property is formed on the surface of the cleaning roller, so that, advantageously, the toner is not easily deposited on the cleaning roller and can be easily removed compared with the case where the roller surface is covered with synthetic rubber (urethane or silicon).

Further, according to the exemplary structure of the present invention, the cleaning roller is placed in the position lower than the cleaning blade, and the cleaning roller touches and thereby rubs the image retainer n times per m copies ($m<n$). In this way, the number of times by which the cleaning roller touches and thereby rubs the image retainer can be effectively reduced, so that the reduction of the efficiency in the image transfer can be prevented, and images can always be securely formed.

With the cleaning roller having the cleaning structure discussed above, a toner filming layer can be removed well. However, if the cleaning roller excessively rubs the image retainer, various problems may arise as in the following examples:

(1) The image retainer is damaged, and it appears in a copy as white lines;

(2) The fluorocarbon polymer on the surface of the cleaning roller moves to an intermediate transfer belt, and the toner does not easily stick to the belt, whereby a toner image on a photoconductor belt is not transferred well to the intermediate transfer belt in the first transfer; and (3) Wear of the intermediate transfer sheet is hastened, density of a finished image is reduced, and the density is not uniform in the image.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cleaning structure of an image retainer for an image forming device, comprising:

an image retainer having a surface movable in a first direction for m times of image formation;

a cleaning blade held by blade supporting means and placed at a desired position on said image retainer;

a cleaning roller held by roller supporting means and placed in a position downstream from said desired position of said cleaning blade on said image retainer with regard to the rotation of said image retainer;

said blade supporting means and said roller supporting means putting said cleaning blade and said cleaning roller in contact with the surface of said image retainer to thereby remove toner remaining on said surface of said image retainer;

said cleaning roller being formed of a roller shaft, a roller base layer and a roller surface layer;

said roller surface layer being a polymer layer being noncohesive and avoiding slippage;

contact means for engaging said cleaning roller with said moving surface of said image retainer against a force urging said cleaning roller away from the surface of the image retainer; and drive control means for giving said contact means instructions to always move n times for the m times of image formation wherein m is greater than n (m>n), the instructions from the drive control means causing the contact means to move from a nonengaged position to engage the cleaning roller with the moving surface of the image retainer.

2. The structure according to claim 1, wherein said polymer layer is a fluorocarbon polymer layer.

3. The structure according to claim 1, wherein said base layer of said cleaning roller is a sponge rubber layer.

4. The structure according to claim 1, wherein said roller supporting means comprises holding means for rotatably holding said cleaning roller away from said image retainer, and rotating means for rotating said cleaning roller in a second direction, the second direction being reverse to the first direction in which the surface of said image retainer moves, rotation of said cleaning means in the second direction aiding removal of toner from the surface of the image retainer when said cleaning roller is in contact with the surface.

5. The structure according to claim 1, wherein when m times of said image formation are 10 to 20 times (m=10 to 20), n times for contact means instructions are 1 to 3 times (n=1 to 3).

6. The structure according to claim 1, wherein said drive control means give said contact means instructions to work n times at a later stage of m times of said image formation.

7. The structure according to claim 4, wherein said holding means comprises a case, a shaft and a spring, said case housing said cleaning roller rotatably therein and being pivotably supported by the shaft within a body of the image forming device, and the spring urges said case to move said cleaning roller away from said moving surface of said image retainer; and said contact means comprises a cam, a second shaft and a solenoid, the cam being movable into contact with said case and being pivotably supported by the second shaft, and the solenoid pivoting said cam and said case against a force of said spring so that said cleaning roller can touch said moving surface of said image retainer.

8. The structure according to claim 1, wherein said blade supporting means comprises a holder pivotably supported by a shaft, for holding said cleaning blade within a body of the image forming device, a spring for pulling said holder to move said cleaning roller away from said moving surface of said image retainer, and a solenoid for pivoting said holder against a force of said spring so that said cleaning blade can touch said moving surface of said moving image retainer.

9. The structure according to claim 1, wherein the image forming device is an electrostatic transfer copying machine.

10. The structure according to claim 7, wherein said rotating means further comprises a motor fixed to the case of the holding means, said motor being operatively connected to the cleaning roller via at least one gear.

11. The structure according to claim 4, wherein said roller supporting means comprises a case for housing the cleaning roller and wherein the rotating means comprises a motor fixed to the case and operatively connected to the cleaning roller, said motor driving the cleaning roller in the second direction.

* * * * *